US007093812B1

(12) United States Patent
Nordeen

(10) Patent No.: US 7,093,812 B1
(45) Date of Patent: Aug. 22, 2006

(54) MULTIPURPOSE CAMPING HOOK

(76) Inventor: Cleve E. Nordeen, 139 Francis Marion Dr., Wilmington, NC (US) 28411

( * ) Notice: Subject to any disclaimer, the term of this patent is extended or adjusted under 35 U.S.C. 154(b) by 95 days.

(21) Appl. No.: 10/748,790

(22) Filed: Dec. 30, 2003

Related U.S. Application Data

(60) Provisional application No. 60/436,726, filed on Dec. 30, 2002.

(51) Int. Cl.
*F16B 45/00* (2006.01)

(52) U.S. Cl. ..... 248/304; 248/690

(58) Field of Classification Search ..... 248/301, 248/304, 690, 692, 215, 217.3, 218.3, 218.4, 248/219.4, 339, 217.4, 218.1

See application file for complete search history.

(56) References Cited

U.S. PATENT DOCUMENTS

| | | | | | |
|---|---|---|---|---|---|
| 11,416 | A | * | 8/1854 | Taylor | 114/61.3 |
| 501,197 | A | * | 7/1893 | Taylor | 248/218.3 |
| 684,312 | A | * | 10/1901 | Rush | 248/216.1 |
| 891,538 | A | * | 6/1908 | Greenman | 248/301 |
| 891,539 | A | * | 6/1908 | Greenman | 248/301 |
| 939,318 | A | * | 11/1909 | Redman | 248/301 |
| 1,301,500 | A | * | 4/1919 | Reynolds | 211/85.3 |
| 1,731,408 | A | * | 10/1929 | Finnessy | 81/3.09 |
| 3,883,934 | A | * | 5/1975 | Rochfort | 248/65 |
| 5,337,986 | A | * | 8/1994 | Vollink | 248/218.4 |

* cited by examiner

*Primary Examiner*—A. Joseph Wujciak
(74) *Attorney, Agent, or Firm*—Mills Law Firm PLLC

(57) ABSTRACT

A multipurpose camping hook for mounting any available support surface includes a plurality of functional surfaces and contours for hanging equipment, clothing and associated articles, as well as providing tools for supplemental tasks. In combination with like articles, the hangers may be used for stringing lines and rods for additional organizational capabilities.

6 Claims, 2 Drawing Sheets

MULTIPURPOSE CAMPING HOOK

RELATED APPLICATION

This application claims the benefit under 35 USC 121 of U.S. Provisional Application No. 60/436,726 filed on Dec. 30, 2002 in the name of the applicant of the present invention and entitled "Multipurpose Camping Hook".

FIELD OF THE INVENTION

The present invention relates generally to outdoor equipment and, in particular, to a multiple purpose device that may be utilized for various outdoor activities and clamped to vertical surfaces for supporting and hanging camping gear and the like.

BACKGROUND OF THE INVENTION

Outdoor recreational activities such as camping, hunting, fishing, boating, hiking and the like generally require the transport of diverse equipment and clothing. When a destination is reached, food, equipment and clothing must be stored for organization, storing, and drying, preferably above ground to avoid moisture, contamination and pests. Rarely does the location provide satisfactory available sites.

The present invention provides a multipurpose camping hook that may be secured to virtually any available support surface. The hook includes a plurality of functional surfaces and contours for hanging equipment, clothing and associated articles, as well as providing tools for supplemental tasks. In combination with like articles, the hangers may be used for stringing lines and rods for additional organizational capabilities.

BRIEF SUMMARY OF THE INVENTION

The present invention provides a hanger for attachment to a vertical support wherein a unitary hook member has a barbed rear section for mechanically engaging the vertical support and a front section having outwardly extending projecting arms for supporting articles therefrom, the hook member having a center transverse opening through which an adjustable strap member extends through for encompassing and clamping to the vertical support.

DESCRIPTION OF THE DRAWINGS

The above and other features and advantages of the invention will become apparent upon reading the following detailed description taken in conjunction with the accompanying drawings in which.

DETAILED DESCRIPTION OF THE PREFERRED EMBODIMENT

Figure 1:
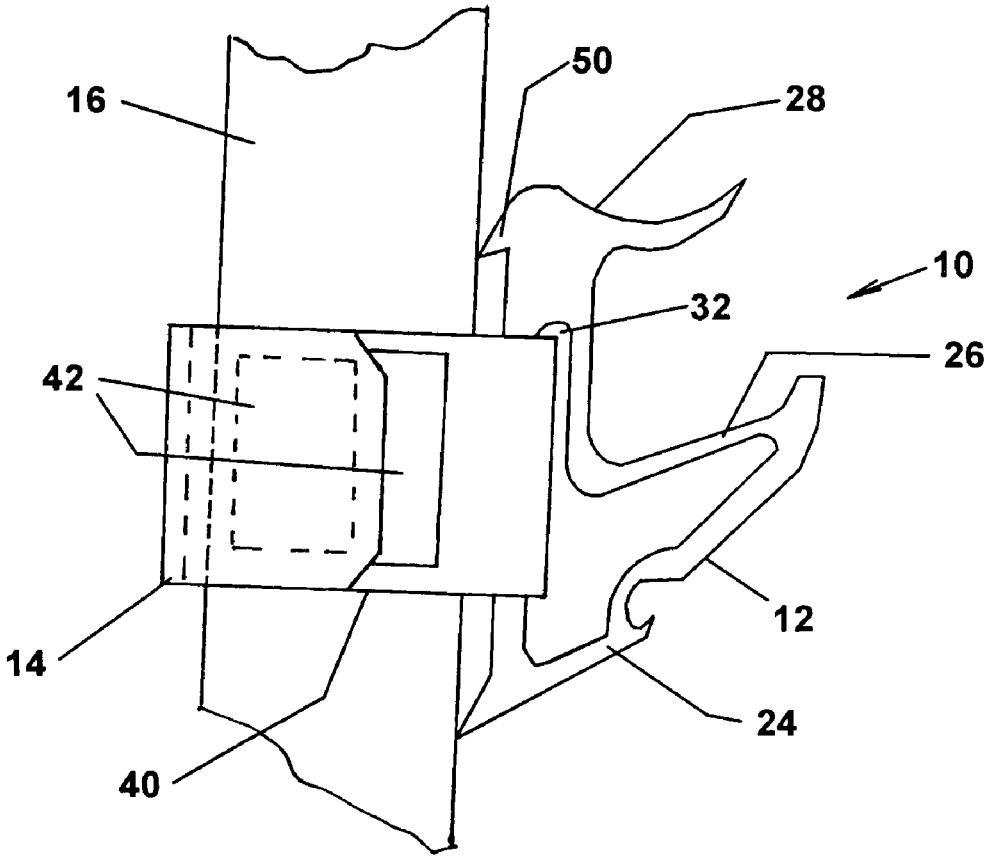
FIG. 1 is a side elevational view of the multipurpose camping hook attached to a tree.

Referring to the drawings, FIG. 1 shows a multipurpose camping hook 10 comprising a hook or hanger 12 having an adjustable strap 14 for attaching the hook to an available vertical support member, such as a tree or pole 16.

Figure 2:
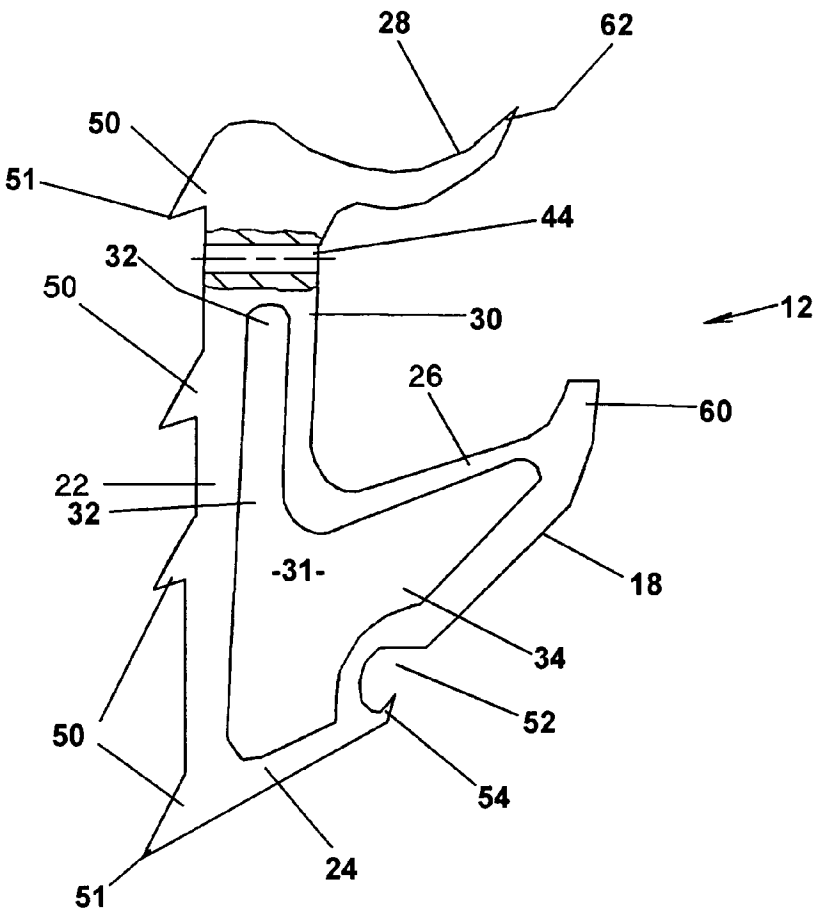
FIG. 2 is a side elevational view of the camping hook of FIG. 1.
Figure 3:
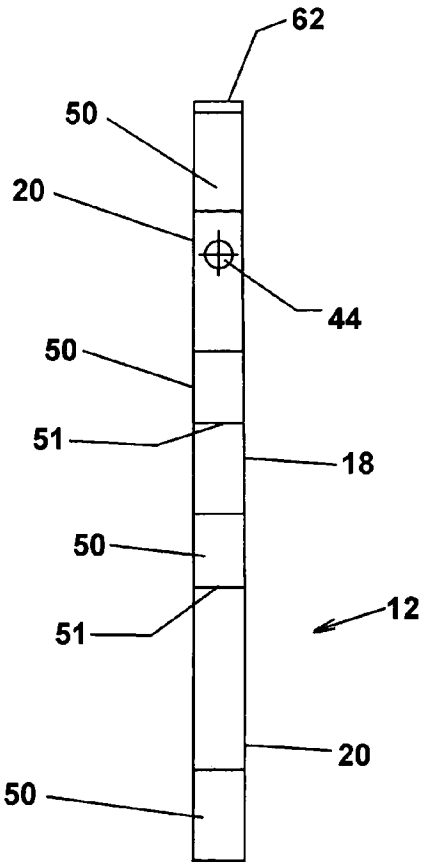
FIG. 3 is a partially sectioned front view of the hook.

Referring additionally to FIGS. 2 and 3, the hanger 12 is a unitary body 18 having parallel planar sides 20. The outer peripheral contour of the body 18 includes a barbed vertical base 22, an upwardly inclined lower base leg 24 merging with a medial horizontal center arm 26, and a vertical outwardly extending top arm 28 spaced from the center arm by a front leg 30, all as inwardly defined by a center opening 31. The center opening 31 includes an elongated rearward vertical slot 32 joined with a frontally upwardly extending, handgrip slot 34.

The strap 14 includes an elongated woven band 40 having a generally rectangular cross section that extends transversely through the slot 32 and wraps around the support pole 16. The band 40 includes a hook and loop fastener assembly 42 for securing the ends of the band 40 at a desired location. A through hole 44 is formed in the leg 30 of the base 32 for accommodating a mechanical fastener to fixedly connect the hanger 12 to a support surface in lieu of the strap 14.

The base leg 22 is provided with a vertical series of rearwardly pointed barbs 50 having downwardly projecting triangular tips 52. In assembly, the barbs 50 mechanically engage the support member 16 to resist vertical slippage. Additionally, the barbs 50 are effective for supplemental activities such as scraping functions or scaling fish, with the user conveniently gripping the hook 12 through the center opening 31.

The base leg 24 is provided with an upwardly recessed, semicircular transverse notch 52 terminating with a sharp inwardly projecting tip 54 for functioning as a bottle opener to remove a cap from a container.

The center arm 26 is inclined slightly upwardly terminating with a transverse ledge 60. The arm 26 and the ledge 60 provide a retaining projection for directly hanging articles therefrom.

The top arm 28 also projects outwardly terminating with a narrow terminal tip 62 that functions as a screwdriver tip and a scalloped upper surface. The top arm 28 provides a secondary projection for vertically supporting articles. The slopes and contours of the arms 26, 28 provides for affirmative retention of the articles hung or supported therefrom.

The hooks 10 may be individually supported on adjacent vertical supports and interconnected with lines, poles, shelves or other horizontal rigid members for providing extended support lengths to handle a plurality of components. Moreover, the inclination or the arms provides affirmative retention for interconnection and supporting.

Preferably, the hook is formed of a rigid material such as metal or plastic having sufficient strength for the intended purposes. The foregoing objectives have been achieved with aluminum plate with a thickness of about ½, a height of about 3½ inches and a width of about 2¼ inches. The hook may be anodized, if desired. A woven nylon strap, about 1 inch wide with a hook and loop fastening system, provides sufficient gripping to hold a wide variety of articles and attendant weights. Mechanical strap connectors may be alternatively employed.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claim.

What is claimed:

1. A multipurpose camping hook for supporting articles on a vertical support member and for performing ancillary functions at a site, said hook comprising: a unitary hook body having transversely spaced side surfaces, said hook body including a vertical base, an outwardly and upwardly projecting upper arm formed at an upper end of said base, an outwardly and upwardly projecting lower arm formed at a lower end of said base, and an outwardly and upwardly projecting middle arm formed at a center section of base said middle arm having an outer end merging with an outer end of said lower arm; an aperture formed through said base between said upper arm and said middle arm for enabling attaching said hook member to said support member using a mechanical fastener; a transverse opening formed in said hook body between said arms and said base; a plurality of vertically spaced, outwardly and downwardly projecting triangular barbs formed on a rear surface of said base for mechanically engaging said support member and for performing scrapping functions at said site; a forwardly opening recessed notch formed in a lower surface of said lower arm, and a sharp tip on said lower arm projecting inwardly into said notch for enabling removing of a cap on a container inserted into said notch; and means terminating with a thin transverse tip at an outer end of said upper arm for functioning as a screw driver.

2. The camping hook as recited in claim 1 wherein an elongated strap member is inserted through said opening, said strap member including closure means for wrapping around said vertical support to clamp said barbs against said vertical support to mount said unitary body thereon.

3. The camping hook as recited in claim 2 wherein said closure means are adjustable for accommodating vary sized supports.

4. The camping hook as recited in claim 3 wherein said closure means include a hook and loop fastener system.

5. The camping hook as recited in claim 1 wherein said unitary body is formed of a metallic material.

6. The camping hook as recited in claim 1 wherein said unitary body is formed of a plastic material.

* * * * *